United States Patent [19]

Stolpe

[11] 4,332,287

[45] Jun. 1, 1982

[54] ROLLING SAFETY DOORS

[75] Inventor: Rudolf Stolpe, Chomedy Laval, Canada

[73] Assignee: Dynaflair Corporation Canada, Inc., Canada

[21] Appl. No.: 149,528

[22] Filed: May 13, 1980

[51] Int. Cl.[3] ..... E06B 9/08

[52] U.S. Cl. ..... 160/133; 160/229 R

[58] Field of Search ..... 160/235, 229 R, 225, 160/228, 133, 201

[56] References Cited

U.S. PATENT DOCUMENTS

| | | | |
|---|---|---|---|
| 2,642,018 | 6/1953 | Weeber | 160/235 UX |
| 2,951,533 | 9/1960 | Lucas et al. | 160/201 X |
| 2,956,314 | 10/1960 | Rowe et al. | 160/201 X |
| 3,419,064 | 12/1968 | Oddicini | 160/229 R |
| 3,670,797 | 6/1972 | Sassano | 160/235 X |
| 4,120,340 | 10/1978 | Stascavage et al. | 160/133 |

*Primary Examiner*—Philip C. Kannan

*Attorney, Agent, or Firm*—Sim & McBurney

[57] ABSTRACT

There is provided a rolling door construction which includes a plurality of spaced-apart elongated members, each having opposed longitudinal slots, and each slot in section having an enlarged internal portion and a neck portion which is narrower than the internal portion. The construction further includes a plurality of light-transmitting panels of uniform thickness, each panel having opposing side edges and opposing end edges, the two opposing side edges of each panel being received in the slots in two adjacent elongated members. There is also provided a plurality of spacer plate members, each spacer plate member having opposed edge beads received in the internal portions of two slots, the beads being too large to be withdrawn through the neck portions of the slots. The spacer plate members are arranged so that two of them are adjacent the end edges of each panel. Means are provided for restraining movement of the panels and the plate members longitudinally of the elongated members.

7 Claims, 3 Drawing Figures

ROLLING SAFETY DOORS

This invention relates generally to rolling door constructions, of the kind used for safety precautions in store fronts and the like.

It is an aspect of this invention to provide a rolling door design having a novel construction which is easily assembled, and which allows for the use of transparent or semi-transparent plastic panels as an integral part of the construction. Moreover, the plastic panels not only provide a see-through feature of the rolling door construction, but also function as constructional spacer units which are essential mechanically to the overall design.

Accordingly, this invention provides a rolling door construction comprising:

a plurality of spaced-apart elongated members, each member having opposed longitudinal slots, each slot in section having an enlarged internal portion and a neck portion narrower than said internal portion, a plurality of light-transmitting panels of uniform thickness, each panel having opposing side edges and opposing end edges, the two opposing side edges of each panel being received in the slots in two adjacent elongated members, a plurality of spacer plate members, each spacer plate member having opposed edge beads received in the internal portions of two slots, the beads being too large to be withdrawn through the neck portions of the slots, the spacer plate members being arranged so that two of them are adjacent the end edges of each panel, and means for restraining movement of the panels and the plate members longitudinally of the elongated members.

One embodiment of this invention is illustrated in the accompanying drawings, in which like numerals denote like parts throughout the several views, and in which.

Figure 1:
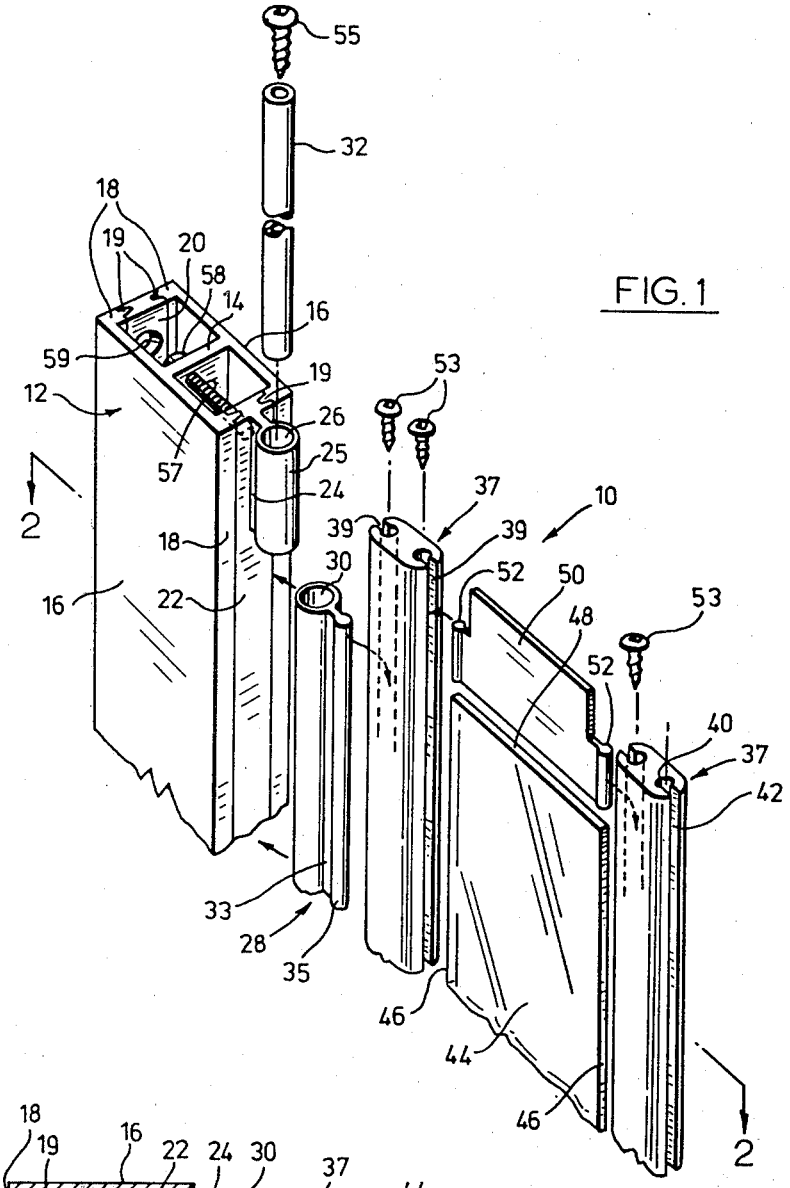
FIG. 1 is a partial, perspective, exploded view of the primary components of the rolling door construction in accordance with this invention.

Referring to the figures, particularly FIG. 1, the rolling door construction shown generally at 10 is seen to include a relatively strong and rigid structural member 12 which in section is H-shaped, with a central web 14 and parallel side walls 16. At the adjacent ends of the two side walls 16 there are provided inward flanges 18, each having a tongue 19, which is adapted to make a tongue-and-groove fit with a filler 20 at the further or leftward edge of the member 12 in FIG. 1, and with a knuckle plate 22 at the nearer or rightward end of the structural member 12 as seen in FIG. 1. Projecting integrally from both ends of the knuckle plate (only one end seen in FIG. 1) is a knuckle web 24 which is integral with a tubular hinge knuckle 25, the latter having a circular inner bore 26.

Figure 3:
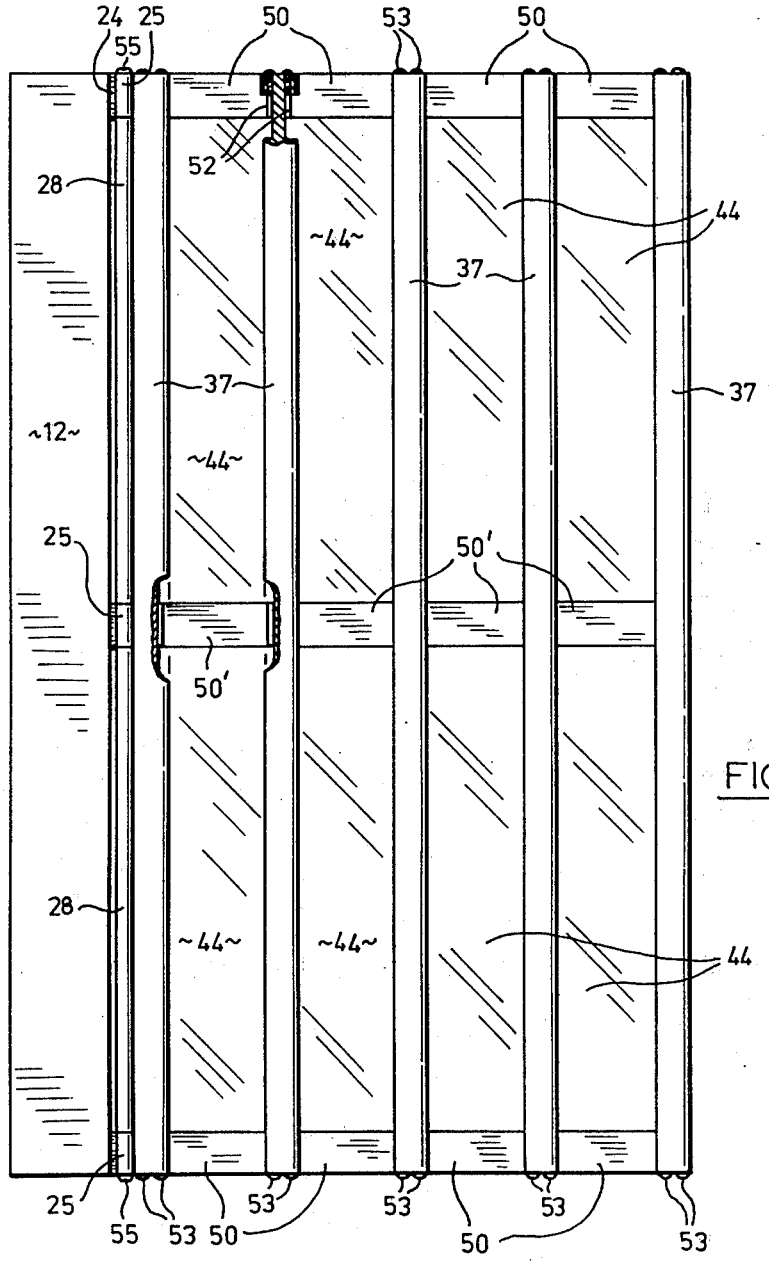
FIG. 3 is an elevational view, partly broken away, of several adjacent panels of the rolling door construction of this invention.

As further seen in FIG. 1, there is provided a hinge member 28 which includes an elongated tubular portion 30 which is adapted to receive a hinge pin 32, and a web portion 33 which projects radially from the tubular portion 30, the web portion 33 having remote from the tubular portion 30 a bead 35. The hinge member 28 extends substantially the full length between adjacent hinge knuckles 25. In FIG. 3 there is shown an arrangement in which three hinge knuckles 25 are provided at spaced intervals along the structural member 12, and two hinge members 28 are located between each pair of adjacent hinge knuckles 25.

Returning to FIG. 1, the construction further includes a plurality of elongated members 37 of identical construction, each elongated member defining two opposed longitudinal slots 39, each slot in section having an enlarged internal portion 40 and a neck portion 42 narrower than the internal portion 40 (see particularly the rightward elongated member 37 in FIG. 1). More particularly, the internal portion 40 of each slot 37 is substantially of circular section, while the neck portion 42 is defined between two substantially parallel walls, in the preferred embodiment.

Figure 2:
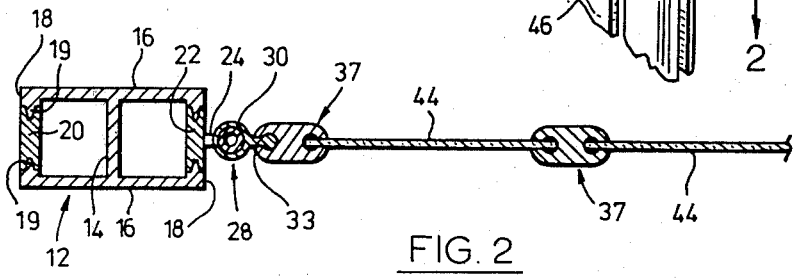
FIG. 2 is a sectional view taken along the line 2—2 in FIG. 1.

The construction disclosed herein further includes a plurality of light-transmitting panels 44 of substantially uniform thickness, each panel having opposing side edges 46 and opposing end edges 48 (only one end edge visible in FIG. 1). While it is not essential that the opposing pairs of edges be parallel, this would be a preferred construction, in view of the uses to which the rolling door construction would be put. As can be seen by comparing FIGS. 1 and 2, the light-transmitting panels 44 are arranged such that the two opposing side edges 46 are received in the slots 39 in two adjacent elongated members 37. In FIG. 1, the various members are exploded or spaced from one another, but FIG. 2 shows the assembled arrangement.

The construction further includes a plurality of spacer plate members 50, each spacer plate member 50 having opposed edge beads 52 received in the internal portions of the respective slots on two adjacent elongated members 37. The beads 52 are too large to be withdrawn through the neck portions of these slots, and therefore the spacer plate members are securely joined to the elongated members 37 once the beads 52 have been received within the slots. Looking at FIG. 3, there are two varieties of the spacer plate members 50, those at the upper and lower end of the overall construction being identical to that shown in FIG. 1, while the spacer plate member 50′ shown in FIG. 3 differs from that shown in FIG. 1 in that the member is completely rectangular, with the beads 52 extending the full length of each respective edge. As can be seen in FIG. 1, the spacer plate member 50 (as opposed to the member 50′) has cut-away portions at the upper outer corners, the purpose of which will be explained subsequently. This means that in the spacer plate members 50, the beads 52 do not extend the full height of the spacer plate member 50.

Returning to the hinge member 28, it will now be understood that the bead 35 which forms a part of the hinge member 28 is received in a slot 39 of the leftward elongated member 37 in FIG. 1, thereby forming a hinge connection between the hinge member 28 and the elongated member 37.

Once the various members have been assembled together with the beads received in the slots, having been inserted longitudinally or end-wise, the entire construction is secured together so that longitudinal removal of the various portions is restrained, by inserting metal screws 53 or similar fasteners, into the ends of the longitudinal slots, more specifically into the enlarged internal portions of the slots. The outer thread diameter of the metal screws is greater than the diameter of the enlarged internal portions of the slots, so that the metal screws cut their way into the slots and bind themselves in position. It will be understood why the spacer plate members 50 have cut-away portions at the upper outer corners, namely to allow the metal screws 53 to enter at least a short distance into the ends of the slots 39.

Assembly of the overall construction also involves inserting the hinge pin 32 through the hinge knuckles 25 and through the tubular portion 30 of the hinge member 28. The hinge pin 32 is preferably a hollow cylinder as illustrated in FIG. 1, and is of a length allowing it to extend the full distance from the upper end of the top hinge knuckle to the lower end of the bottom hinge knuckle 25 (see FIG. 3). To secure the hinge pin 32 in place, two further metal screws 55 are provided, sized so as to be bindingly threaded into the hollow interior of the hinge pin 32 from either end.

Returning to FIG. 1, the knuckle plate 22 is adapted to be held in position by virtue of a bolt 57 having a head 58, access to which is obtained through an opening 59 in member 20. The bolt 57 may either simply bind against the knuckle plate 22, or be threaded for a short distance into a suitably tapped bore in the inner surface of the knuckle plate 22.

To allow a certain degree of pivotal movement of each elongated member 37 with respect to the portions which are received in its respective slot 39, the width of the neck portion 42 of each slot would be sized to be somewhat wider than the thickness of the panels 44 and also wider than the thickness of the plate members 50.

It will now be appreciated that the panels 44 perform a multiple function: namely to act as light transmissive panels, and also as spacer members, in effect spacing apart the members 50. Because of this construction, there is no necessity for holding or retaining the members 50 and 50' at a particular longitudinal position with respect to the elongated members 37. This simplifies the construction considerably, and lowers the cost involved.

I claim:

1. A rolling door construction comprising:

a plurality of spaced-apart elongated members, each member having opposed longitudinal slots, each slot in section having an enlarged internal portion and a neck portion narrower than said internal portion, a plurality of light-transmitting panels of uniform thickness, each panel having opposing side edges and opposing end edges, the two opposing side edges of each panel being received in the slots in two adjacent elongated members, a plurality of spacer plate member, each spacer plate member having opposed edge beads received in the internal portions of two slots, the beads being too large to be withdrawn through the neck portions of the slots, the spacer plate members being arranged so that two of them are adjacent the end edges of each panel, and means for restraining movement of the panels and the plate members longitudinally of the elongated members.

2. The invention claimed in claim 1, in which said last-mentioned means comprises metal screws threaded into the internal portions of the slots at the ends of the elongated members.

3. The invention claimed in claim 1, in which the panels are rectangular.

4. The invention claimed in claim 1, in which the panels are rectangular and are of transparent plastic material.

5. The invention claimed in claim 1, which includes a hinge member having an elongated tubular portion adapted to receive a hinge pin, and a web portion projecting radially from the tubular portion, the web portion having remote from the tubular portion a bead which is received in the internal portion of a slot of one of the elongated members, with the web portion passing through the neck portion of the last-mentioned slot.

6. The invention claimed in claim 5, in which the hinge member is pivotally hinged to a structural member of greater strength than the elongated members.

7. The invention claimed in claim 1, claim 5 or claim 6, in which the elongated members are all of the same length, the internal portion of each slot being of circular section, the neck portion of each slot being wider than the thickness of the panels and the thickness of the plate members, to allow a degree of swivel to take place between each elongated member and the elements received in each of its two slots, the panels being rectangular and being of plastic material.

* * * * *